US006678988B1

(12) United States Patent
Poff, Jr.

(10) Patent No.: US 6,678,988 B1
(45) Date of Patent: Jan. 20, 2004

(54) RECOIL DAMPENING DEVICE FOR GUN SIGHT

(75) Inventor: Charles Richard Poff, Jr., Cape Coral, FL (US)

(73) Assignee: Cape Aerospace, LLC., Cape Coral, FL (US)

( * ) Notice: Subject to any disclaimer, the term of this patent is extended or adjusted under 35 U.S.C. 154(b) by 0 days.

(21) Appl. No.: 10/201,229

(22) Filed: Jul. 23, 2002

(51) Int. Cl.[7] ..... F41G 1/387
(52) U.S. Cl. ..... 42/147; 42/124; 42/127
(58) Field of Search ..... 42/124, 127, 147; 89/41.17

(56) References Cited

U.S. PATENT DOCUMENTS

| | | | | |
|---|---|---|---|---|
| 2,450,466 A | | 10/1948 | Carlson | |
| 2,597,466 A | | 5/1952 | Felix | |
| 3,205,580 A | | 9/1965 | Osborn | |
| 3,483,623 A | | 12/1969 | Kruzell | |
| 3,579,840 A | * | 5/1971 | Heinzel | |
| 4,026,054 A | | 5/1977 | Snyder | |
| 4,027,414 A | | 6/1977 | Felix | |
| 4,446,644 A | | 5/1984 | Jimenez et al. | |
| 5,142,806 A | | 9/1992 | Swan | 42/101 |
| 5,276,988 A | | 1/1994 | Swan | 42/101 |
| 5,396,725 A | * | 3/1995 | Talbot | |
| 5,425,191 A | | 6/1995 | Taylor et al. | 42/101 |
| 5,531,039 A | | 7/1996 | Gore | 42/101 |
| 5,669,173 A | | 9/1997 | Rodney, Jr. | 42/101 |
| D435,885 S | | 1/2001 | Wallace | D22/110 |
| 2003/0056417 A1 | * | 3/2003 | Horton | 42/124 |

FOREIGN PATENT DOCUMENTS

| | | |
|---|---|---|
| FR | 2581746 | 11/1986 |
| FR | 2611036 | 8/1988 |

* cited by examiner

*Primary Examiner*—Stephen M. Johnson
(74) *Attorney, Agent, or Firm*—Price, Heneveld, Cooper, DeWitt & Litton

(57) ABSTRACT

A recoil dampening device for a gun sight includes a first rail member adapted to fixedly mount to a firearm, wherein the first rail member has an elongated body portion and a pair of mounting flanges extending outwardly from and longitudinally along the body portion, and a second rail member having an elongated downwardly opening channel that slidably receives the body portion and mounting flanges of the first rail member therein, wherein the second rail member is adapted to releasably support a gun sight thereon. The sight base also includes at least one deformable recoil absorbing member disposed between the first rail member and the second rail member, wherein the recoil absorbing member is adapted to reduce the recoil transferred from the firearm to the gun sight when the firearm is fired.

24 Claims, 2 Drawing Sheets

RECOIL DAMPENING DEVICE FOR GUN SIGHT

BACKGROUND OF THE INVENTION

The present invention relates to a recoil dampening device, and in particular to a recoil dampening device for reducing the forces exerted onto a gun sight during the operation of an associated firearm.

Recoil absorbing devices are used in a variety of applications within firearms to reduce the forces as exerted on various portions of the firearm as well as the operator. These recoil dampening devices typically include at least two or more parts movable with respect to one another and a recoil dampening device positioned so as to absorb the forces as generated during operation of the firearm.

Heretofore, recoil dampening devices have included multiple components that are difficult to assemble and/or require special tools for assembly and/or adjustment, thereby making assembly and adjustment of the recoil dampening devices difficult in high pressure situations typically associated with military operations. In addition, these recoil dampening devices are not suitable for mating with standardized military equipment. Specifically, these recoil dampening devices are not compatible with the "picatinny-style" mounting configuration. Further, previous recoil dampening devices utilized for mounting a sight base or scope mount onto a firearm do not sufficiently reduce the recoil associated with high caliber firearms.

SUMMARY OF THE INVENTION

One aspect of the present invention is to provide a recoil dampening sight base that includes a first rail member adapted to fixedly mount to a firearm, wherein the first rail member has an elongated body portion and a pair of mounting flanges extending outwardly from and longitudinally along the body portion, and a second rail member having an elongated, downwardly opening channel that slidably receives the body portion of the mounting flanges of the first rail member therein, and wherein the second rail member is adapted to releasably support a gun sight thereon. The recoil dampening sight base also includes at least one elastically deformable recoil absorbing member disposed between the first rail member and the second rail member, wherein the recoil absorbing member is adapted to reduce the recoil transferred from the firearm to the gun sight when the firearm is fired.

Another aspect of the present invention is to provide a firearm for reducing the recoil as transferred to a gun sight mounted thereon, including a body portion of a firearm having an upper surface, a first rail member fixedly mounted to the upper surface of the firearm, wherein the first rail member has an elongated body portion and a pair of mounting flanges extending outwardly from and longitudinally along the body portion, and a second rail member having an elongated, downwardly opening channel that slidably receives the body portion of the mounting flanges of the first rail member therein. The firearm also includes at least one elastically deformable recoil absorbing member disposed between the first rail member and the second rail member, wherein the recoil absorbing member is adapted to reduce the recoil transferred from the firearm to the gun sight when the firearm is fired, and a gun sight releasably mounted with the second rail member.

Yet another aspect of the present invention is to provide a recoil dampening device for a gun sight that includes a first rail member adapted to fixedly mount to a firearm, wherein the first rail member has an elongated body portion and a pair of mounting flanges extending outwardly from and longitudinally along the body portion, and a second rail member having an elongated, downwardly opening channel that slidably receives the body portion and mounting flanges of the first rail member therein, wherein the second rail member also has at least one receiving rail that includes a substantially square shaped body portion and a pair of substantially triangularly shaped mounting flanges extending outwardly from the body portion, and wherein the second rail member is adapted to slidably receive a gun sight thereon. The recoil dampening device also includes a pair of recoil absorbing members juxtaposed across a length of the first rail member and disposed between the first rail member and the second rail member, wherein the recoil absorbing members are adapted to reduce the recoil transferred from the firearm to the gun sight when the firearm is fired.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
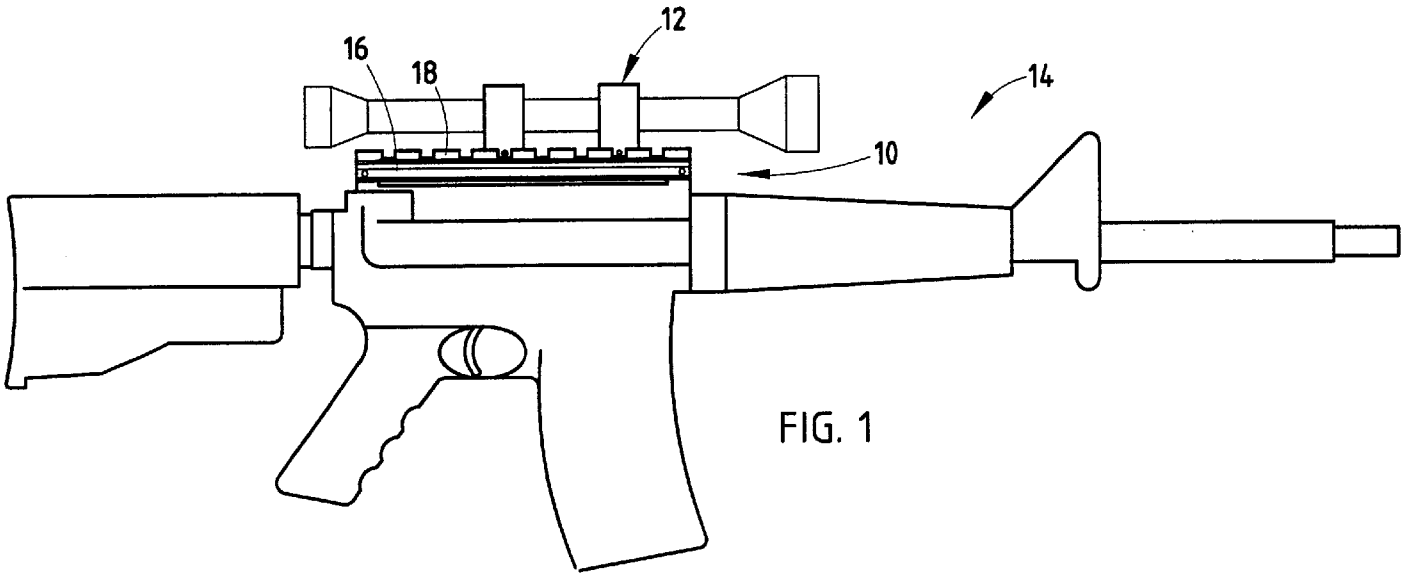
FIG. 1 is a side elevational view of a firearm that includes a recoil dampening device embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a recoil dampening device for mounting a gun sight 12 onto a firearm 14. In the illustrated example, firearm 14 includes a firearm typically associated with military use, however, recoil dampening device 10 may be utilized with numerous firearms regardless of configuration or use.

Figure 3:
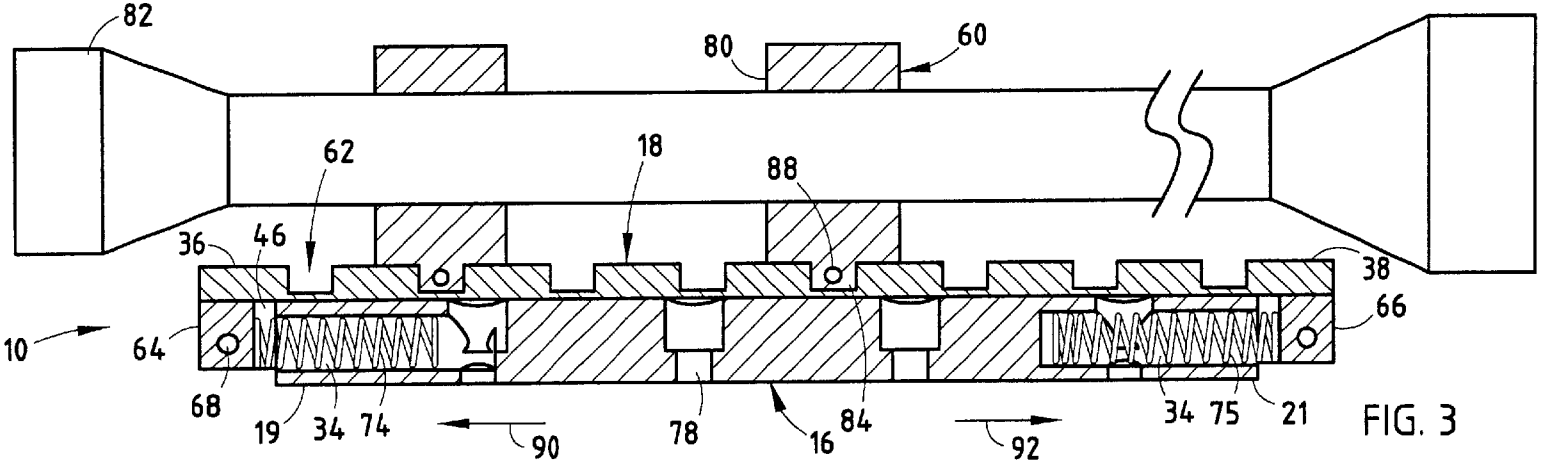
FIG. 3 is a cross-sectional side view of the recoil dampening device supporting a scope mount and scope thereon.
Figures 2, 4:
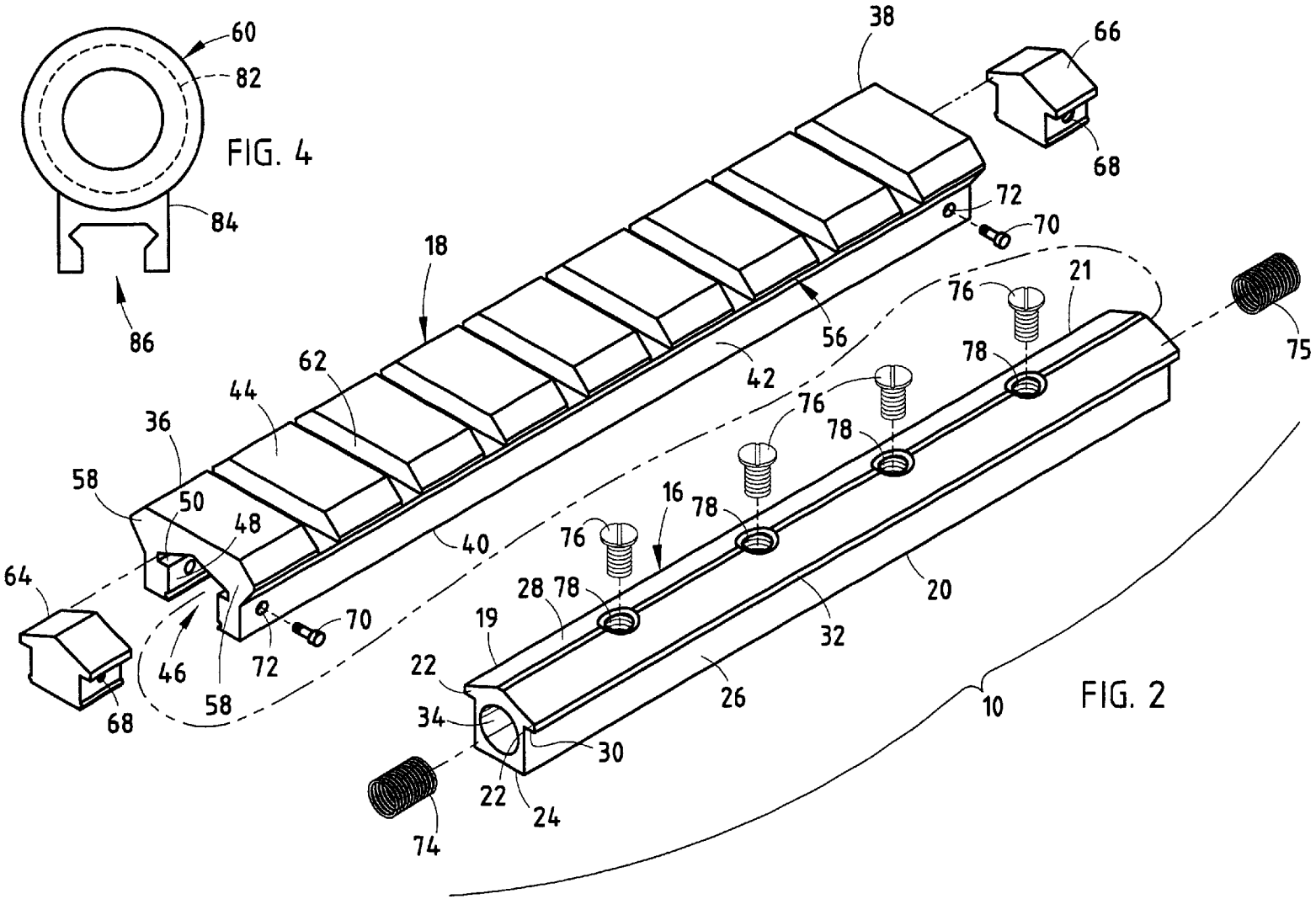
FIG. 2 is an exploded perspective view of the recoil dampening device.
FIG. 4 is an end view of the scope mounted and associated scope.

The recoil dampening device 10 (FIG. 2) includes a first rail member 16 adapted to fixedly mount to firearm 14, and a second rail member 18 slidably mountable upon first rail member 16. First rail member 16 includes a first end 19 and a second end 21. First rail member 16 also includes an elongated body portion 20 and a pair of mounting flanges 22 extending outwardly from and longitudinally along body portion 20. Body portion 20 of first rail member 16 is defined by a flat bottom surface 24, substantially flat sidewall surfaces 26 extending perpendicularly from bottom surface 24 and a triangulated top surface 28. Flanges 22 extend outwardly from sidewall surfaces 26 and are defined by a bottom surface 30 and a sidewall surface 32. The top surface of each flange is coplanar width and blends into top surface 28 of body portion 20. First end 19 and second end 21 of first rail member 16 each include an aperture 34 (FIG. 3) extending into body portion 20.

The second rail member 18 includes a first end 36 and a second end 38. Second rail member 18 is defined by a bottom surface 40, sidewall surfaces 42 and a top surface 44. Second rail member 18 also includes an elongated, longitudinally extending, downwardly opening channel 46 that slidably receives first rail member 16 therein. Channel 46 includes a main channel section 48 configured to slidably receive body portion 20 of first rail member 16 therein, and a pair of outwardly extending side channel sections 50 adapted to slidably receive flanges 22 of first rail member 16 therein. Second rail member 18 also includes a receiving rail 56 that includes a pair of substantially triangularly shaped mounting flanges 58 extending outwardly from sidewall surface 42 and juxtaposed across second rail member 18. Receiving rail 56 is adapted to slidably receive a sight mount thereon as described below. A plurality of gaps or notches 62 along receiving rail 46 and top surface 44 of second rail member 18 divides receiving rail 56 into a plurality of sections, thereby allowing for mid-length mounting of gun sight 12 as described below.

The dampening device 10 also includes a first stop member 64 and a second stop member 66 located within channel 46 near first end 36 of second rail member 18 and second end 38 of second rail member 18, respectively. Each stop member 64 and 66 are provided with cross-sectional geometries similar to that of first rail member 16. Each stop member 64 and 66 are provided with a laterally extending aperture adapted to threadably receive an associated locking screw 70 therein, thereby fixing each stop member 64 and 66 from sliding within channel 46 when each locking screw 70 abuts a sidewall thereof. In assembly, locking screws 70 may be accessed within channel 46 of second rail member 18 via a pair of apertures 72 extending from sidewall surface 42 to channel 46 of second rail member 18.

The dampening device 10 also includes a pair of recoil dampening members 74 juxtaposed along the length of first rail member 16 and located within apertures 34 located at the ends thereof. In the illustrated example, dampening members 74 includes a pair of coil springs, however, other elastically deformable material capable of absorbing the recoil as generated by firearm 14 may be utilized.

In assembly, mounting hardware 76 are located within a plurality of countersunk apertures 78 extending from top surface 28 to bottom surface 24 of first rail member 16 and affixed first rail member 16 to firearm 14. Second rail member 18 is slidably connected with first rail member 16 such that first rail member 16 is located within channel 46 of second rail member 18. Dampening members 74 are located within apertures 34 of first rail members 16 and held in place when stop members 64 and 66 are located within channel 46 of second rail member 18 and affixed thereto as described above.

The sight mount 60 (FIGS. 3 and 4) includes a pair of holding mechanisms 80 adapted to securely hold a gun sight such as a scope 82 securely therein. It should be noted that holding mechanisms 80 may include any structure capable of fixedly holding a gun sight such as scope 82 while mating with a "picatinny-style" rail. As illustrated, sight mount 60 also includes a downwardly extending attachment arm 84. Attachment arm 84 includes a longitudinally extending channel 86 having a cross-sectional geometry that slidably receives receiving rail 56 therein. The width of arm 84 is provided such that arm 84 can be received within notches 62 between each section of receiving rail 56, thereby allowing sight mount 60 and the associated gun sight such as scope 82 to be mounted upon dampening device 10 by slidably attaching arms 84 of sight mount 60 with receiving rail 56 of second rail member 18 without requiring sight mount 60 to be slid the entire length of second rail member 18. Each arm 84 includes an aperture 88 adapted to threadably receive a locking screw (not shown) therein, to affix sight mount 60 to second rail member 18.

In operation, recoil generated by the operation of firearm 14 is lessened or eliminated as the dampening members 74 absorb the recoil from between first rail members 16 and second rail member 18 in effect increasing the amount of dissipation time for the acceleration/deceleration forces as exerted by the firearm (14 onto the gun sight 12, typically occurring during the first 1.5 to 2 milliseconds subsequent to discharge of the firearm 14. Specifically, a recoil force in a direction indicated by arrow 90 is exerted on dampening device 10 when a charge within firearm 14 is detonated, thereby causing the compression of first dampening member 74 between first stop member 64 and first rail member 16 as first rail member 16 slides rearwardly within channel 46 of second rail member 18. The recoil force 90 is absorbed by first dampening member 74, thereby lessening the amount of recoil force 90 as transmitted to second rail member 18 and thus the gun sight supported thereby such as scope 82. A reactionary recoil force 92 is exerted onto dampening device 10 as firearm 14 recoils away from the operator. Recoil force 92 causes a compression of second dampening member 75 between second stop member 66 and first rail member 16 as first rail member 16 slides forwardly within channel 46 of second rail member 18. The recoil force 92 as transmitted to scope 82 is again reduced by the compression of second dampening member 75.

The present inventive recoil dampening sight base provides a more durable sight base having an uncomplicated design that can be easily and quickly assembly without the use of specialized tools. The recoil dampening device is further capable of a long operating life, and is particularly well adapted for the proposed use as it is compatible with geometrical configurations such as the "picatinny-style" rail.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A recoil dampening sight base, comprising:

a first rail member adapted to fixedly mount to a firearm, the first rail member having an elongated body portion and a pair of mounting flanges extending outwardly from and longitudinally along the body portion;

a second rail member having an elongated downwardly opening channel that slidably receives the body portion and mounting flanges of the first rail member therein, at least one receiving rail adapted to slidably receive a gun sight thereon; and at least one elastically deformable recoil absorbing member disposed between the first rail member and the second rail member, wherein the recoil absorbing member is adapted to reduce the recoil transferred from the firearm to the gun sight when the firearm is fired.

2. The sight base of claim 1, wherein the receiving rail of the second rail member includes a body portion and a pair of mounting flanges extending outwardly from the body portion.

3. The sight base of claim 2, wherein the at least one receiving rail includes a plurality of receiving rails defining mounting spaces therebetween, thereby allowing the mounting of the gun sight with the receiving rails without requiring gun sight to be slid along a full length of the second rail member.

4. The sight base of claim 3, wherein the body portion of the receiving rail is provided a substantially rectangular cross-sectional shape, and wherein the mounting flanges of the receiving rail are provided a substantially triangular cross-sectional shape.

5. The sight base of claim 4, further including:

a first stop member attached to a first end of the second rail; and a second stop member attached to a second end of the second rail;

wherein the at least one recoil absorbing member includes a first absorbing member and a second absorbing member, wherein the first absorbing member is located between the first stop member and a first end of the first rail member, and wherein the second absorbing member is located between the second stop member and a second end of the first rail member.

6. The sight base of claim 5, wherein the first stop member and the second stop member are each received within the channel of the second rail member.

7. The sight base of claim 6, wherein the first and second stop members each include a body portion and a pair of mounting flanges extending outwardly from the body portion, and wherein the first and second stop members may be slidably received within the channel of the second rail member and then fixedly attached to the second rail member.

8. The sight base of claim 7, wherein the first end of the first rail member includes a longitudinally extending bore the receives at least a portion of the first recoil absorbing member therein, and wherein the second end of the first rail member includes a longitudinally extending bore that receives at least a portion of the second recoil absorbing member therein.

9. The sight base of claim 8, wherein the first recoil absorbing member and the second recoil absorbing member each include a coil spring.

10. A recoil dampening sight base, comprising:

a first rail member adapted to fixedly mount to a firearm, the first rail member having an elongated body portion and a pair of mounting flanges extending outwardly from and longitudinally along the body portion;

a second rail member having an elongated downwardly opening channel that slidably receives the body portion and mounting flanges of the first rail member therein, the second rail member adapted to releasably support a gun sight thereon; and a first stop member attached to a first end of the second rail;

a second stop member attached to a second end of the second rail;

at least one elastically deformable recoil absorbing member disposed between the first rail member and the second rail member, wherein the at least one recoil absorbing member includes a first absorbing member and a second absorbing member, the first absorbing member is located between the first stop member and a first end of the first rail member, the second absorbing member is located between the second stop member and a second end of the first rail member, and wherein the recoil absorbing member is adapted to reduce the recoil transferred from the firearm to the gun sight when the firearm is fired.

11. The sight base of claim 10, wherein the first stop member and the second stop member are each received within the channel of the second rail member.

12. The sight base of claim 11, wherein the first and second stop members each include a body portion and a pair of mounting flanges extending outwardly from the body portion, and wherein the first and second stop members may be slidably received within the channel of the second rail member and then fixedly attached to the second rail member.

13. The sight base of claim 10, wherein the first end of the first rail member includes a longitudinally extending bore the receives at least a portion of the first recoil absorbing member therein, and wherein the second end of the first rail member includes a longitudinally extending bore that receives at least a portion of the second recoil absorbing member therein.

14. The sight base of claim 10, wherein the first recoil absorbing member and the second recoil absorbing member each include a coil spring.

15. A firearm for reducing the recoil as transferred to a gun sight mounted thereon, comprising:

body portion of a firearm having an upper surface;

a first rail member fixedly mounted to the upper surface of the firearm, the first rail member having an elongated body portion and a pair of mounting flanges extending outwardly from and longitudinally along the body portion;

second rail member having an elongated downwardly opening channel that slidably receives the body portion and mounting flanges of the first rail member therein, and at least one receiving rail adapted to slidably receive the gun sight thereon;

at least one elastically deformable recoil absorbing member disposed between the first rail member and the second rail member, wherein the recoil absorbing member is adapted to reduce the recoil transferred from the firearm to the gun sight when the firearm is fired; and a gun sight releasably mounted with the second rail member.

16. The firearm of claim 15, wherein the receiving rail of the second rail member includes a body portion and a pair of mounting flanges extending outwardly from the body portion.

17. The firearm of claim 16, wherein the at least one receiving rail includes a plurality of receiving rails defining mounting spaces therebetween, thereby allowing the mounting of the gun sight with the receiving rails without requiring gun sight to be slid along a full length of the second rail member.

18. The sight base of claim 16, wherein the body portion of the receiving rail is provided a substantially rectangular cross-sectional shape, and wherein the mounting flanges of the receiving rail are provided a substantially triangular cross-sectional shape.

19. A firearm for reducing the recoil as transferred to a gun sight mounted thereon, comprising:

body portion of a firearm having an upper surface;

a first rail member fixedly mounted to the upper surface of the firearm, the first rail member having an elongated body portion and a pair of mounting flanges extending outwardly from and longitudinally along the body portion;

a second rail member having an elongated downwardly opening channel that slidably receives the body portion and mounting flanges of the first rail member therein, a first stop member attached to a first end of the second rail;

a second stop member attached to a second end of the second rail;

at least one elastically deformable recoil absorbing member disposed between the first rail member and the second rail member, the at least one recoil absorbing member includes a first absorbing member and a second absorbing member, the first absorbing member located between the first stop member and a first end of the first rail member, the second absorbing member located between the second stop member and a second end of the first rail member, and wherein the recoil absorbing member is adapted to reduce the recoil transferred from the firearm to the gun sight when the firearm is fired; and a gun sight releasably mounted with the second rail member.

20. The firearm of claim 19, wherein the first stop member and the second stop member are each received within the channel of the second rail member.

21. The firearm of claim 20, wherein the first and second stop members each a include a body portion and a pair of mounting flanges extending outwardly from the body portion, and wherein the first and second stop members may be slidably received within the channel of the second rail member and then fixedly attached to the second rail member.

22. The firearm of claim 19, wherein the first end of the first rail member includes a longitudinally extending bore the receives at least a portion of the first recoil absorbing member therein, and wherein the second end of the first rail member includes a longitudinally extending bore that receives at least a portion of the second recoil absorbing member therein.

23. The firearm of claim 19, wherein the first recoil absorbing member and the second recoil absorbing member each include a coil spring.

24. A recoil dampening device for a gun sight, comprising:

a first rail member adapted to fixedly mount to a firearm, the first rail member having an elongated body portion and a pair of mounting flanges extending outwardly from and longitudinally along the body portion;

a second rail member having an elongated downwardly opening channel that slidably receives the body portion and mounting flanges of the first rail member therein, the second rail member also having at least one receiving rail that includes a substantially square shaped body portion and a pair of substantially triangularly shaped mounting flanges extending outwardly from the body portion, and that is adapted to slidably receive a gun sight thereon; and a pair of recoil absorbing members juxtaposed across a length of the first rail member and disposed between the first rail member and the second rail member, wherein the recoil absorbing members are adapted to reduce the recoil transferred from the firearm to the gun sight when the firearm is fired.

* * * * *

UNITED STATES PATENT AND TRADEMARK OFFICE

CERTIFICATE OF CORRECTION

PATENT NO. : 6,678,988 B1
DATED : January 20, 2004
INVENTOR(S) : Poff Jr.

It is certified that error appears in the above-identified patent and that said Letters Patent is hereby corrected as shown below:

Column 3,
Line 48, “includes” should be -- include --.

Column 4,
Line 23, after “14” insert -- ) -- (close parenthesis).
Line 42, “assembly” should be -- assembled --.

Column 5,
Line 42, “the receives” should be -- that receives --.

Column 6,
Line 20, “the receives” should be -- that receives --.
Line 30, before “body” insert -- a --.
Line 36, before “second” insert -- a --.
Line 56, before “gun” insert -- the --.
Line 65, before “body” insert -- a --.

Column 7,
Line 29, delete “a” before “include”.

Column 8,
Line 3, “the receives” should be -- that receives --.

Signed and Sealed this

Twenty-fifth Day of May, 2004

JON W. DUDAS
*Acting Director of the United States Patent and Trademark Office*